US005357941A

United States Patent [19]

Hans Duerichen et al.

[11] Patent Number: 5,357,941

[45] Date of Patent: Oct. 25, 1994

[54] REFRACTORY BAFFLE INSERT FOR FIREPLACE

[76] Inventors: J. G. Hans Duerichen, 3721 16th Avenue; Bruce Akre, Kitsequecla Road, both of Smithers, British Columbia, Canada, V0J 2N0

[21] Appl. No.: 62,180

[22] Filed: May 17, 1993

[51] Int. Cl.[5] ..... F24B 1/188

[52] U.S. Cl. ..... 126/531; 126/77; 110/305; 110/315

[58] Field of Search ..... 126/531, 77, 515; 110/305, 315

[56] References Cited

U.S. PATENT DOCUMENTS

| | | | |
|---|---|---|---|
| 600,603 | 3/1898 | Bacon | 110/305 |
| 4,363,785 | 12/1982 | Willson | 126/77 |
| 4,752,218 | 6/1988 | Nos | 110/336 |
| 4,854,298 | 8/1989 | Craver | 126/77 |
| 5,188,528 | 2/1993 | Rast | 110/336 |
| 5,259,758 | 11/1993 | Lauersdorf | 110/336 |

FOREIGN PATENT DOCUMENTS

| | | | |
|---|---|---|---|
| 2004553 | 6/1990 | Canada . | |
| 2008981 | 8/1990 | Canada . | |
| 2001309 | 4/1991 | Canada . | |
| 2039866 | 10/1991 | Canada . | |
| 2040556 | 10/1992 | Canada . | |
| 8292 | 3/1906 | Denmark | 110/305 |
| 347029 | 2/1905 | France | 110/305 |
| 16061 | 7/1896 | United Kingdom | 110/305 |

*Primary Examiner*—Carroll B. Dority
*Attorney, Agent, or Firm*—McFadden, Fincham

[57] ABSTRACT

There is disclosed a refractory baffle for use in a fireplace which dispenses, via apertures provided therein, preheated combustion air over the central combustion zone of the fireplace. The refractory material substantially avoids warpage, flame quenching and other limitations associated with metal baffles.

5 Claims, 4 Drawing Sheets

REFRACTORY BAFFLE INSERT FOR FIREPLACE

FIELD OF THE INVENTION

The present invention relates to a fuel burning fireplace and more particularly to an improved baffle for use in such fireplaces.

BACKGROUND OF THE INVENTION

Generally speaking, hollow baffle structures are used in wood stoves and fireplaces to provide preheated combustion air. This provision reduces emissions and enhances combustion of the products within the stove or fireplace.

Presently, metal baffles are used in the art. Although baffles composed of metal have utility, they are susceptible to warping from the heat and are believed to quench the flames which may cause an increased in emissions.

The cost of replacement of an ineffective baffle as well as the potential for combustion product deposit within the chimney of a stove or fireplace indicate that a more effective arrangement is required.

The prior art has provided several baffle structures, typical of which is illustrated in Canadian Patent Application Serial No. 2,001,309. This reference teaches a generally triangular hollow baffle composed of metal. Apertures are provided in a localized area of the baffle for directing preheated combustion air over the flames in the combustion area. There is no discussion or contemplation for the use of a refractory composition for the baffle.

Canadian Patent Application Serial No. 2,004,553 discloses the use of a ceramic material of which the baffle is made. The combustion air is not preheated and dispensed through the baffle. The baffle is devoid of openings over its surface and thus cannot enhance combustion by the use of preheated air.

Canadian Patent Application Serial No. 2,008,981 teaches a primarily mechanical arrangement for introducing preheated air into the path of solid fuel combustion residues. The arrangement includes metal parts and accordingly, may be susceptible to warpage.

Further, Canadian Patent Application Serial No. 2,040,556 teaches a baffle including a heat exchanger, primarily composed of metal. The arrangement provides a tiered structure having an opening therein for the passage of preheated air. The unit may be susceptible to overheating the air to the point where the air is expanded too much to be effective.

SUMMARY OF THE INVENTION

One object of the present invention is to provide an improved baffle construction suitable for use in a fireplace.

A further object of the present invention is to provide a baffle suitable for use in a fireplace, the fireplace having a central combustion zone and a first air inlet, the baffle comprising:

- a hollow body of refractory material having a first upper wall and a second lower wall, the walls being in spaced relation, an open end and a closed end;
- inlet means for receiving air from the first air inlet;
- the lower wall including at least one opening therethrough for passing air received in the inlet means through the lower wall and into the combustion zone.

The baffle, being made of a refractory material substantially reduces the limitations associated with metal baffles, such as warping, overheating and emissions.

As a further attendant feature, the baffle is lightweight. Reinforcements, e.g. stainless steel pins, may be added to impart additional strength when required.

Suitable refractory materials for use in the baffle include, for example, aluminum and silicon containing refractory compositions.

In an alternate embodiment, the baffle may be cast integrally with refractory walls and a base thus forming a central combustion zone with the baffle positioned above the combustion zone.

Further, the baffle may be divided into separate compartments by partitions disposed internally of the baffle.

The baffle may also be simply employed in retrofit applications.

A further object of one embodiment of the present invention is to provide a fireplace for burning solid fuel comprising:

- a central combustion zone;
- a first air inlet for supplying air to the central combustion zone;
- an exhaust outlet for removal of combustion exhaust;
- a hollow baffle composed of a refractory material disposed above the central combustion zone, the baffle having inlet means in fluid communication with the first air inlet, a first upper wall and a second lower wall in spaced relation, an open end and closed end, the second lower wall including outlet means for passing air from within the baffle into the central combustion zone.

Having thus generally described the invention, reference will now be made to the accompanying drawings illustrating preferred embodiments.

DETAILED DESCRIPTION OF THE PREFERRED EMBODIMENTS

Figure 1:
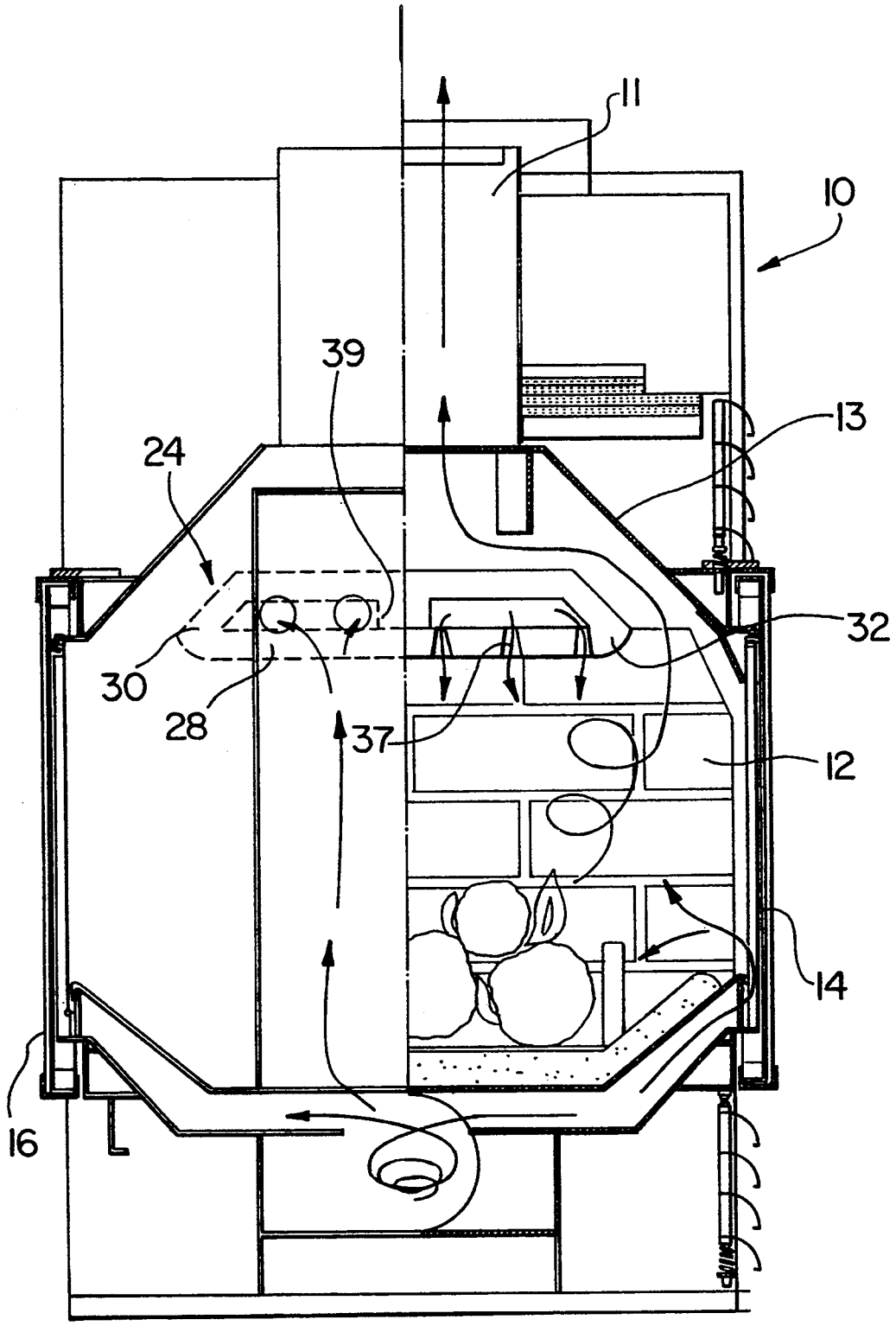
FIG. 1 is a side view of an embodiment of the present invention as positioned within a fireplace.
Figure 2:
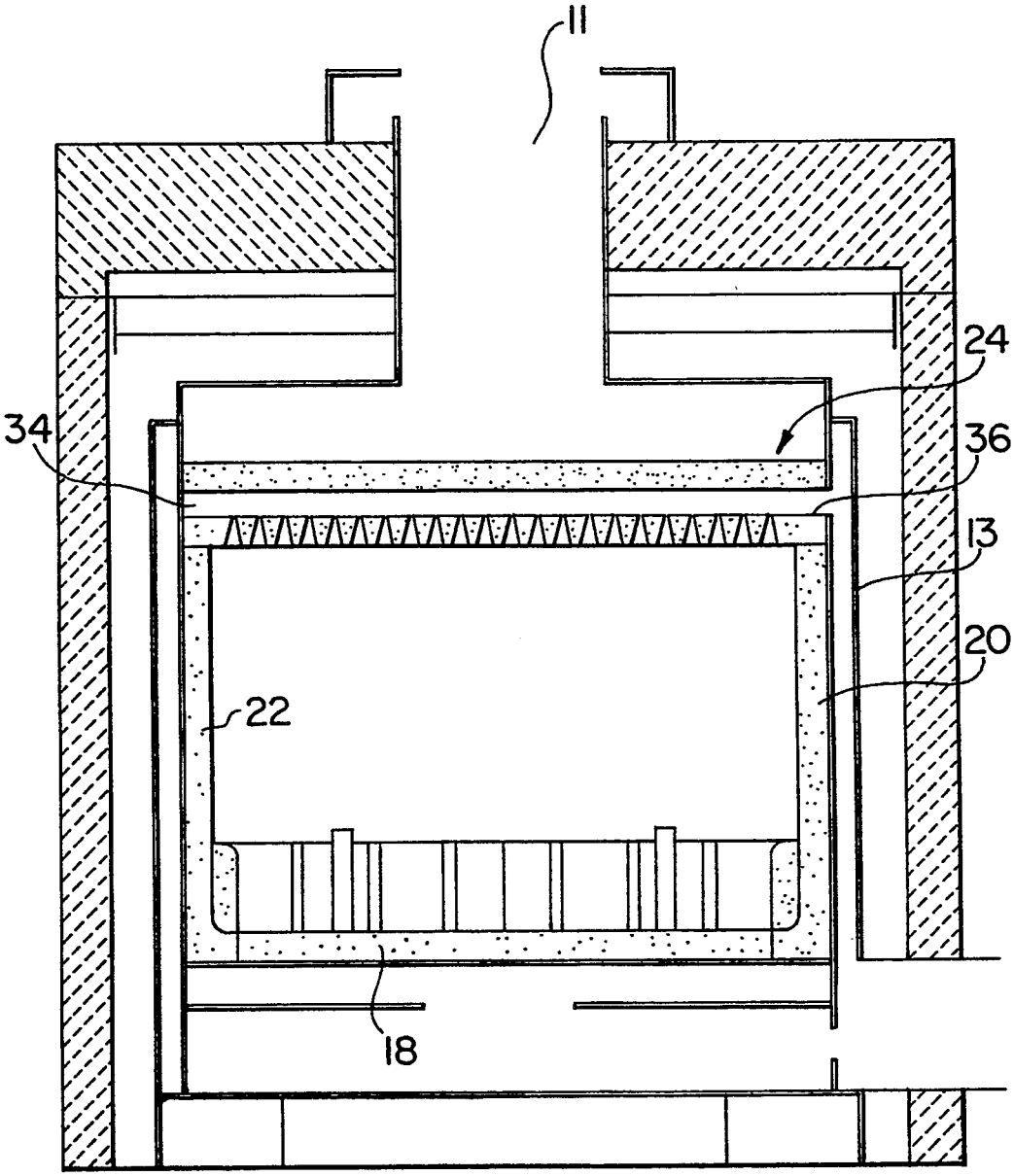
FIG. 2 is a front elevational view of FIG. 1.

Referring now to the drawings, FIG. 1 illustrates a side view of a fireplace 10 having chimney section 11 and a central combustion zone 12 surrounded by an outer skin 13 or casting. Doors 14 and 16 provide for access to zone 12. A refractory lining is provided within zone 12 and includes a base 18 and sides 20 and 22. Disposed above the combustion zone 12, there is included a baffle 24, shown in one embodiment in FIG. 1.

Figure 4:
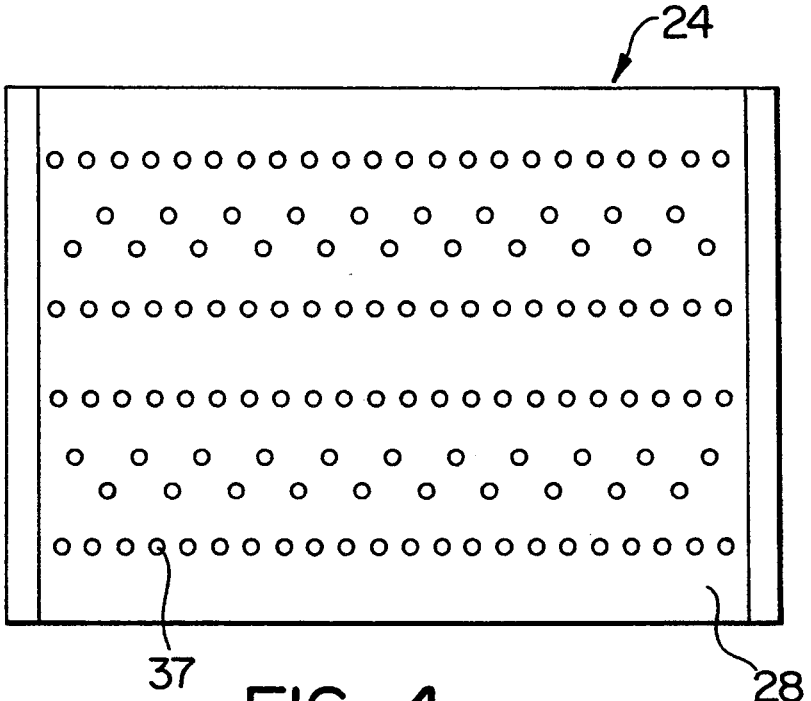
FIG. 4 is a bottom plan view of the baffle of FIG. 1.

The baffle 24 includes an upper wall 26 and a lower wall 28 in spaced relation and joined edges 30 and 32. Ends 34 and 36 are open such that baffle 24 is a hollow structure. Lower wall 28 includes a plurality of openings 37. The arrangement of the openings 37 is illustrated in FIG. 4. One or both of the open ends 34 and 36 receive combustion air from an air inlet 38 beneath base 18 of combustion zone 12. Air entering into inlet 38 travels upwardly toward baffle 24 and more particularly, in the space between either or both of sides 20 and/or 22 and outer skin 13. The air may be partially heated during the course of travel. The air enters baffle 24 as indicated above and is further heated prior to dispensing over the central combustion zone 12 via apertures 37. A partition 39 may be provided within the baffle 24 for additional strength or for dispensing air evenly to both sides of the central combustion zone 12.

Turning to the baffle 24 in greater detail, successful results have been achieved by making the baffle of a refractory material rather than metals as previously proposed in the art. Refractory material for use in the baffle circumvents warping, overheating of the combustion air and significantly reduced flame quenching, all of which are pronounced when metal is employed.

In a preferred form, the refractory compound comprises Plibrico ® Plicast LWI 25. The refractory material typically contains a high percentage of $Al_2O_3$ and $SiO_2$ as well as $Fe_2O_3$, $TiO_2$, CaO, MgO and various other alkalies. The baffle composition has low coefficient of thermal conductivity which makes it attractive for long lasting use in the fireplace. Further materials may be mixed with the refractory composition to reduce brittleness, e.g. stainless steel needles.

The refractory baffle has been found to be particularly effective in preventing overheating of the combustion air. Generally speaking, if combustion air becomes overheated, the same can become so expanded that it is no longer effective in enhancing combustion.

Figure 3:
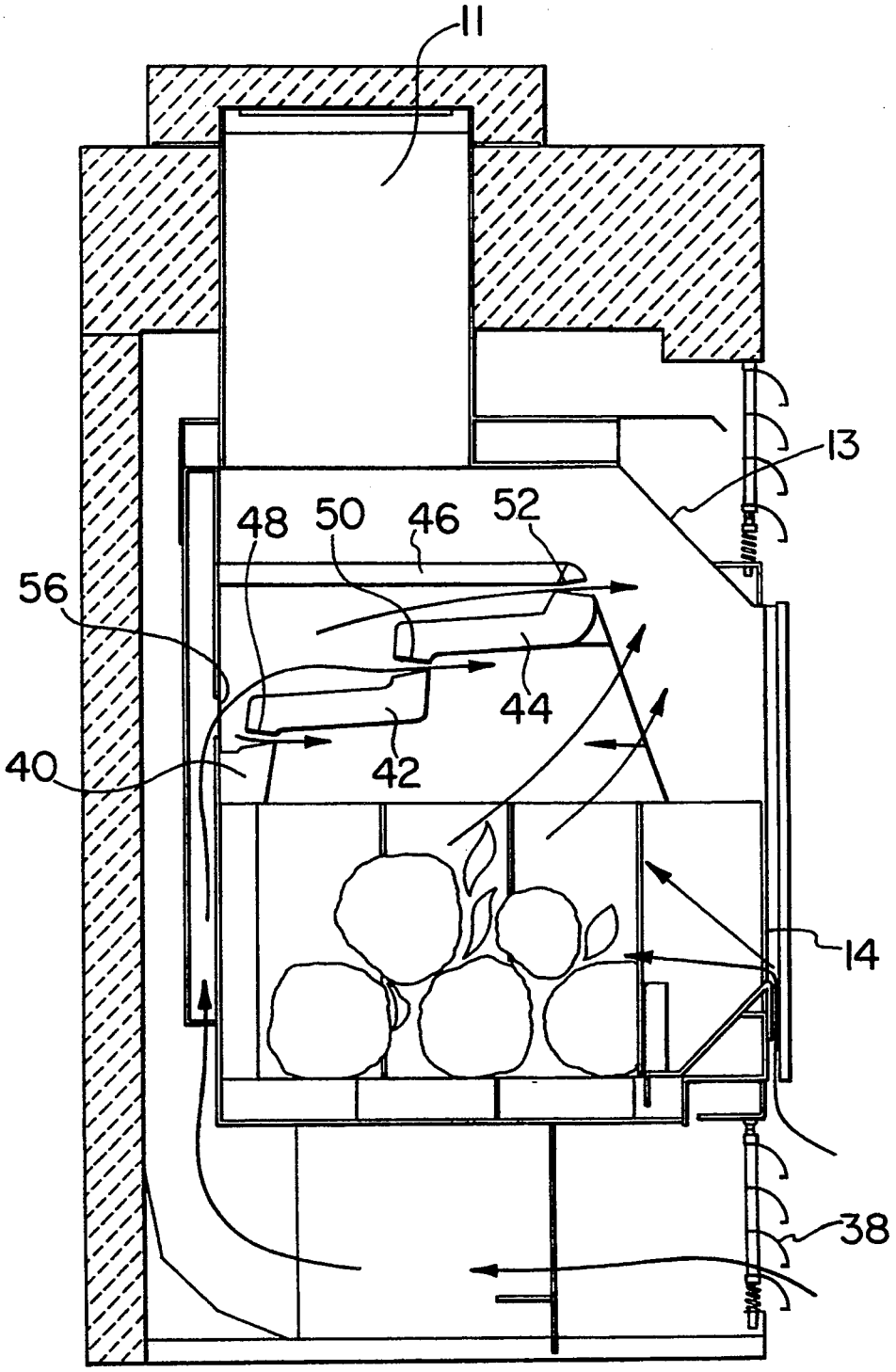
FIG. 3 is a side view of an alternate embodiment of the present invention.

FIG. 3 illustrates a side view of another embodiment in which common numerals from the previous embodiment denote similar elements.

Figure 5:
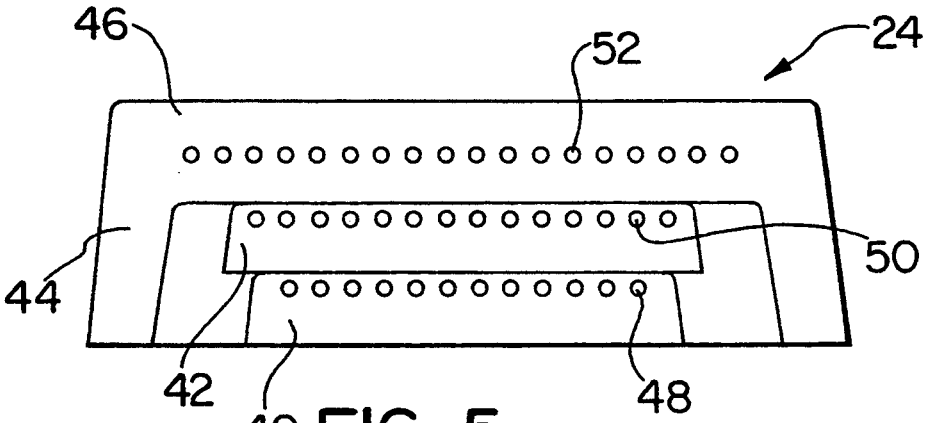
FIG. 5 is a front elevational view of the baffle illustrated in FIG. 3.

The embodiment illustrated in FIG. 3 provides a hollow baffle 24 having first, second and third staggered and tiered walls 40, 42 and 44 and an upper wall 46. Openings 48, 50 and 52 extend between walls 40, 42 and 44. The arrangement of the walls and apertures is shown more clearly in FIG. 5. Air travelling through inlet 38 passes in the space between skin 13 and a back wall 54 of fireplace 10.

An opening 56 in back wall 54 permits entry of the air within baffle 24. The air within baffle 24 is at least partially heated before being dispensed over the central combustion zone 12 through openings 48, 50 and 52.

By making use of the refractory baffle, the air dispensed into the central combustion zone assists in enhancing the combustion process which, in turn, results in a greater amount of heat being produced. Clearly, the refractory composition may be molded to provide a host of hollow baffle structures with two or more walls in spaced relation and the specific number and structure will vary with intended applications. Additionally, the baffle arrangements set forth herein may easily be employed in fluid fuel fireplaces, stoves, etc.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. A fireplace for burning solid fuel comprising:

means forming a central combustion zone;

a first air inlet means for supplying air to said central combustion zone;

means forming an exhaust outlet at an upper end of said fireplace for removal of combustion exhaust;

a hollow baffle composed of a refractory material disposed above and extending from one side to another of said fireplace and further extending from a rear wall of said fireplace toward a front of said fireplace, said baffle having at least one inlet in fluid communication with said first air inlet to heat said air, a first upper wall and a second lower wall in spaced relation, said hollow baffle being spaced from a front of said fireplace to provide an exhaust path to said exhaust outlet, said second lower wall including a plurality of apertures for dispensing air heated from within said baffle into said central combustion zone, whereby combustion is enhanced in said combustion zone.

2. The baffle as defined in claim 1, wherein said baffle is a lightweight baffle.

3. The baffle as defined in claim 1, wherein said baffle includes a reinforcing material therein.

4. The baffle as defined in claim 3, wherein said reinforcing material comprises stainless steel pins.

5. The fireplace as set forth in claim 1, wherein said baffle includes an intermediate wall between said upper wall and said lower wall, said intermediate wall having outlet means.

* * * * *